United States Patent [19]

Curtis

[11] 4,083,074

[45] Apr. 11, 1978

[54] MULTIPURPOSE PIPELINE PIG

[75] Inventor: Arvel C. Curtis, Dallas, Tex.

[73] Assignee: Mustang Services Co., Oklahoma City, Okla.

[21] Appl. No.: 751,344

[22] Filed: Dec. 16, 1976

[51] Int. Cl.[2] ..... B08B 9/04

[52] U.S. Cl. ..... 15/104.06 R; 137/268; 166/153; 166/170

[58] Field of Search ..... 15/104.06 R, 104.06 A, 15/104.06 B, 3.5, 3.51; 134/8; 166/153–156, 170–176, 70; 137/268

[56] References Cited

U.S. PATENT DOCUMENTS

| | | | |
|---|---|---|---|
| 1,994,072 | 3/1935 | Hardcastle | 166/155 |
| 2,480,358 | 8/1949 | Curtis et al. | 15/104.06 R X |
| 3,102,595 | 9/1963 | Fisher, Jr. et al. | 166/156 |
| 3,545,542 | 12/1970 | Scott | 166/155 |
| 3,616,850 | 11/1971 | Scott | 166/155 |

*Primary Examiner*—Edward L. Roberts

[57] ABSTRACT

A multipurpose pig for treating the interior of pipes or for conveying material through a pipeline constructed of a main body portion having a length approximately one and one-half times its diameter with one end of the body portion being cup-shaped and including flanges extending outwardly therefrom. The other end of the main body includes a hub with a central opening therethrough for securing a plurality of cutting blade elements to the hub for cleaning the interior of pipelines with the passage of the multipurpose pig therethrough. The main body portion further includes a plurality of sealing elements extending from the hub to the cup-shaped flange with the diameter of the plurality of sealing elements and said flange being approximately equal.

5 Claims, 8 Drawing Figures

56
58
62
P
64
CK
60
50
66
68
70
GAS FLOW
52
54

MULTIPURPOSE PIPELINE PIG

BACKGROUND OF THE INVENTION

The present invention relates to apparatus for cleaning transmission and pipelines in situ underground, and more particularly to such apparatus which also is capable of performing additional functions associated with transmission lines or pipelines in situ underground.

It is common practice to provide pipelines or transmission lines with exterior coating as the pipelines or transmission lines are positioned in the earth's surface to inhibit corrosion and electrolytic action which might deteriorate the pipes sufficiently to eventually cause a rupture or break therein. However, interior coating of a pipe is now accomplished by various methods including joint-by-joint coating prior to the time that the joints are coupled together and lowered into the earth's surface. Other methods now used employ techniques in which the transmission line or pipe may be cleaned and coated while in situ. However, such methods and techniques have various disadvantages such that they are not efficient for commercial and practical exploitation.

SUMMARY OF THE INVENTION

The present invention relates to apparatus whereby a transmission line may be cleaned in situ underground in a manner to overcome the aforementioned and other problems in connection with the interior cleaning of pipelines.

A further object of the present invention is to provide apparatus whereby a transmission line may be cleaned in situ underground to remove deposits, scale, and corrosion therefrom prior to the application of a coating on the interior of the transmission line.

Still another object of the present invention is to provide apparatus whereby slugs of cleaning material may be conveyed sequentially through a transmission line in situ to clean the entire circumferential extent of the transmission line.

Yet another object of the present invention is to provide apparatus for moving cleaning fluids and scraping element sequentially through a transmission line in situ underground, such moving including the positioning of barriers or pigs in the transmission line to form chambers for receiving the cleaning material and applying a fluid pressure on each of the barriers with the fluid pressure on one of the barriers being greater than the fluid pressure on the other barrier forming a chamber so that the barriers and filled chambers of cleaning material may be conveyed through the transmission line.

And yet a further object is to provide a multipurpose pig element capable of traversing variable-sized pipelines, including out-of-round pipe, short radius bends, metered joints, valves and other restrictions normally found in pipelines.

The apparatus of the present invention comprises a flexible-expandible, compressible multipurpose pipeline pig which is resistant to the products normally conveyed by the transmission or pipeline and additionally is resistant to acids and chemicals which are commonly used to clean the interior of such pipelines in situ. The multipurpose pig or barrier of the present invention has the capability of resisting heat from minus 60° F. to 350° F. The pipeline pig is capable of traversing pipelines of variable sizes, for example from 20 – 24" diameter or other similar diameter ranges of pipe, including out-of-round pipe, short radius bends, mitered joints, valves and other restrictions normally found in pipe or transmission lines. The multipurpose pig is capable of travelling in excess of one hundred miles through pipelines in situ with a minimum amount of wear even under extreme conditions incurred with such usage.

The multipurpose pig is also capable of being used to control the movement of liquids through a pipeline in situ in product separation applications. The multipurpose barrier also includes a flexible scraper attachment for the removal of scale and deposits from the inner walls of the pipeline. The multipurpose pig is also adaptable to be used as a jet pig to move sand and other solids from the pipeline without the hazards of plugging the pipeline with the solid mass.

The multipurpose pig in accordance with the present invention is preferably made from a formula of high grade urethane resins and other components which are molded into one single body with multiple sealing elements for pressure control. However, highly resistant urethane compounds known to those skilled in the art may also be used.

BRIEF DESCRIPTION OF THE DRAWINGS

The above objects, advantages and features of the present invention will be clearly understood from the following description taken in conjunction with the drawings wherein.

DETAILED DESCRIPTION OF THE INVENTION

Figure 1:
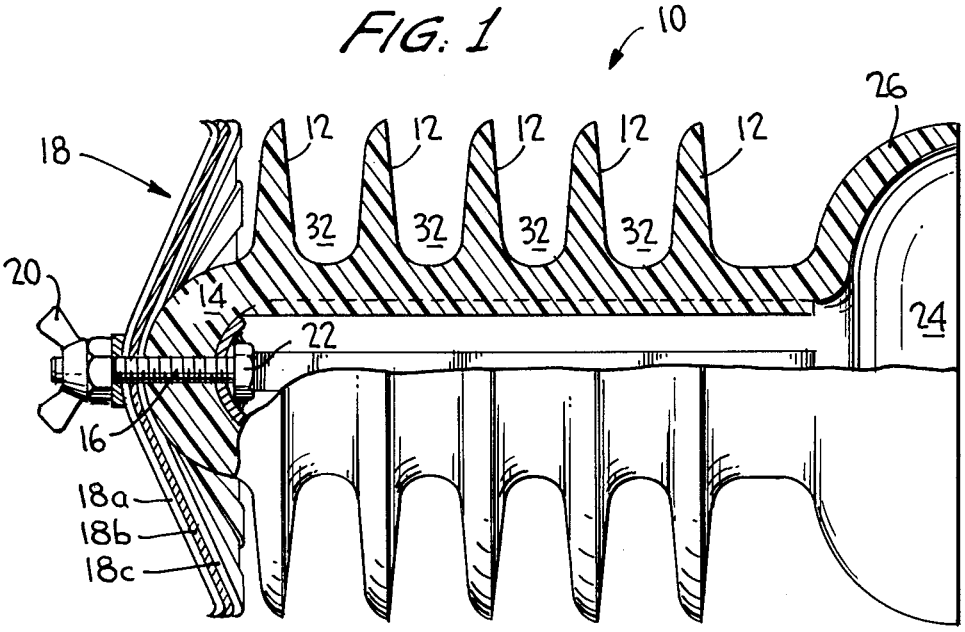
FIG. 1 is a longitudinal cross-section view of an exemplary embodiment of the multipurpose pig of the present invention.

The multipurpose pig of the present invention comprises a body 10 made of 100% urethane and molded into a single body having multiple sealing elements 12, each having a radiused edge at the radially outer extremity thereof. The high grade urethane is extremely highly resistant to wear such that it will withstand passage through the interior of transmission or pipelines while traversing therethrough in tight engagement with the interior of the pipe. One end 14 of the multipurpose pig is formed in the shape of a hub including a hole centrally located therein through which is inserted bolt 16 for attaching scraper elements 18 to the multipurpose pig by means of wing nut 20 and internal nut 22. The other end of the multipurpose pig is in the form of a cup 24 having flange 26. The diameter of cup 24, the diameter of multiple sealing elements 12 and the effective diameter of scraper element 18 are substantially the same such that all of the aforesaid elements engage the interior of the pipe into which the multipurpose pig is inserted.

Figure 3:
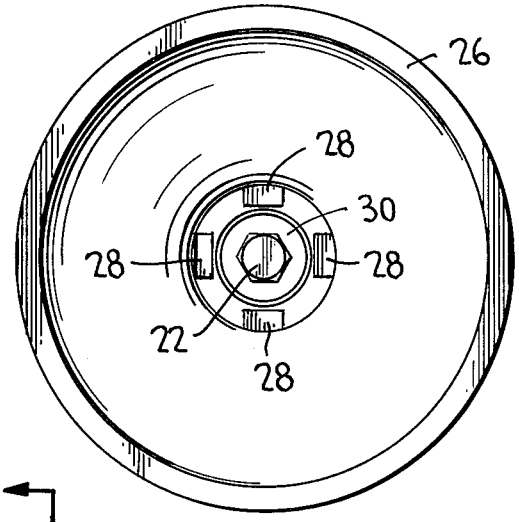
FIG. 3 is a view of the end opposite the scraper attachment illustrating the reinforcing ribs extending along the length of the pig element.

As illustrated in FIG. 3, the interior of multipurpose pig 10 is hollow and includes reinforcing rib members 28 which extend along the longitudinal axis of the pig element to provide reinforcement thereof. Central opening 30 provides access to the end 22 of bolt 16 for the purpose of removing the scraper elements 18 from the body of multipurpose pig element 10. The length of multipurpose pig element 10 is substantially one and one-half times its diameter, which provides a preferred length-to-diameter ratio such that the multipurpose pig element can negotiate sharp bends and turns in a transmission or pipeline and yet pass T sections or obstructions in such a pipe or transmission line without being misdirected into another section of the pipeline or being blocked within the pipe.

The following are exemplary dimensions of a multipurpose pig element in which the diameter of the first multiple sealing element near hub end 14 is 12.750 inches with the diameter increasing to 12.870 inches at cup 24. The length of multipurpose pig element 10 is 21.637 inches. The U-shaped portions 32 between the multiple sealing elements 12 have approximately a radius of ⅝ of an inch. The thickness of the multipurpose pig at the cross sections of the U-shaped sections is approximately ¾ of an inch. The radius of the upper end portions of the multiple sealing elements 12 is approximately ½ inch. The aforesaid dimensions would be adjusted proportionally in accordance with the diameter of the multipurpose pig. The multipurpose pig in accordance with the present invention may be used in pipes having diameters from two inches up to forty-eight inches or more.

Figure 2:
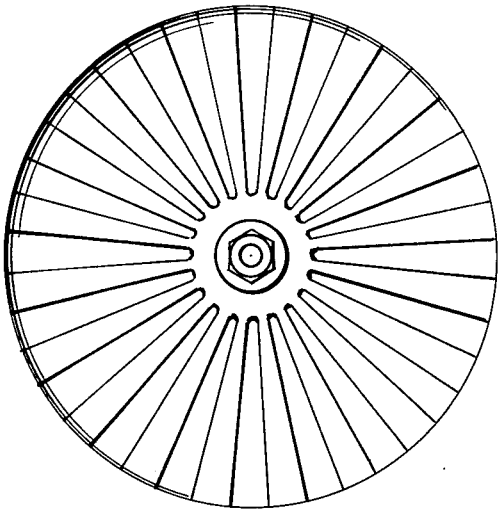
FIG. 2 is a front view of the attachable cutter elements of the multipurpose pig of the present invention.

FIG. 2 is a front view of multipurpose pig element 10 illustrating the formation of the plurality of cutter elements 18*a*, 18*b* and 18*c* which are mounted thereon. Each of cutter elements 18*a*, 18*b*, 18*c* includes a plurality of radially extending cutter blades as illustrated in FIGS. 1 and 2. Each of the cutter or scraper elements 18*a*, 18*b* and 18*c* is preferably made of fifteen gauge material and is formed in substantially the shape illustrated in FIG. 1 such that the diameter of the cutter elements is approximately the same diameter as the multiple sealing elements 12.

Figure 4:
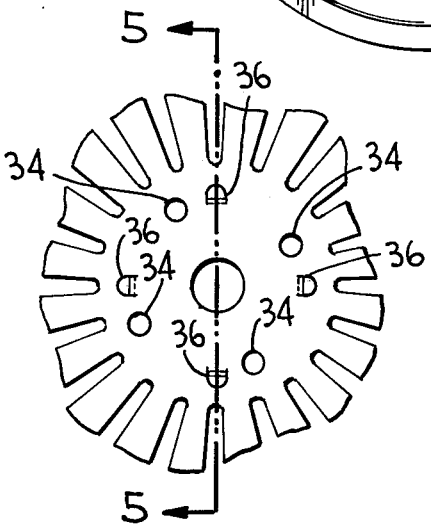
FIG. 4 is a partially cutaway view of the cutter element illustrating the apertures and guide members for attaching the same to the multipurpose pig.

As illustrated in FIG. 4, each of the scraper elements 18*a*, 18*b*, 18*c* includes holes 34 and hemispherically-shaped apertures 36 spaced as illustrated. Apertures 36 are adapted to be engaged with holes 34 of an ajdacent positioned cutter element so that the cutter elements will be firmly affixed to multipurpose pig element 10 when attached thereto by wing nut 20 and bolt 16 as illustrated in FIG. 1. The angle between aperture 36 and a hole 34 is approximately 18°, which conforms to the preferred spacing of the cutter element on a cutter blade or scraper element 18*a*, 18*b* or 18*c*. Thus, when the cutter elements are assembled as illustrated in FIG. 1, the periphery of scraper 18 comprises an essentially solid cutter element for scraping the interior of a transmission line or pipe.

Figure 5:
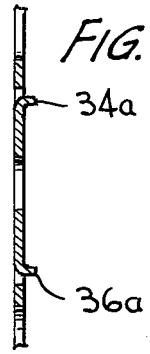
FIG. 5 is a cross section taken through lines 5–5 of FIG. 4.

FIG. 5 illustrates a cross section taken through lines 5—5 of FIG. 4 showing the nipple 36*a* formed in aperture 36 to provide engagement with an adjacent hole 34 of an adjacent positioned cutter element.

Figures 6, 7A, 7B:
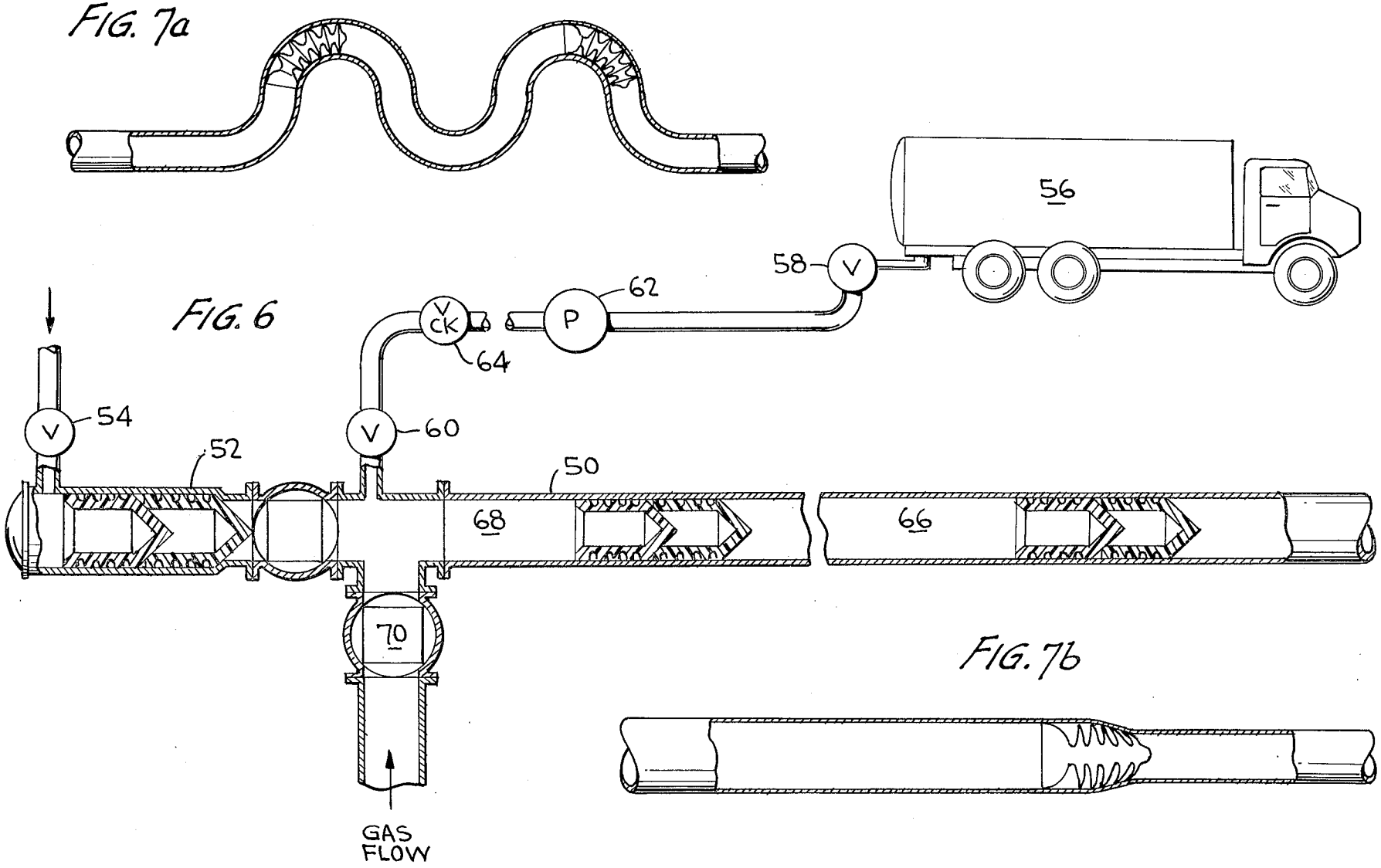
FIG. 6 is an illustration of an application of the use of the multipurpose pig of the present application showing the elements in nested relationship to form barriers and chambers for separating different liquids for transportation through a pipeline; and FIGS. *7a* and *7b* illustrate the traversal of a multipurpose pig in accordance with the present invention through small radius bends and through a pipeline having two different diameters at different sections, respectively.

FIG. 6 illustrates a typical application of multipurpose pig element 10 wherein several of the multipurpose pig elements are used in nested relationship and paired to form successive chambers along a transmission or a pipeline for the purpose of transmitting different fluids which for some reason or another are desired to be kept separate during their passage through the transmission or pipeline. In this application, the cutter elements 18 are removed from multipurpose pig element 10, although bolt 16 remains in place so as to block passage of the liquids through the multipurpose pig element. Hub 14 (FIG. 1) is so dimensioned that it will fit within central opening 30 at cup-shaped end 24 of another multipurpose pig element to enable the pig elements to engage in nested relationship. FIG. 6 also serves to illustrate the manner in which a multipurpose pig element may be moved through a transmission or pipeline. In FIG. 6 transmission line 50 is illustrated in situ and may be of any length such as from a relatively short length of several hundred years to many hundreds or even thousands of miles. At each end of the portion of the transmission line which is being conditioned, there is secured an elongated tubular element or sleeve 52 (only one of which is illustrated in FIG. 6). Sleeve 52 includes valve 54 for controlling the admission of air to sleeve 52 and pipeline 50 for the purpose of providing sufficient pressure to force the nested multipurpose pig elements 10 through the transmission line. At the opposite end of the transmission line there is included a similar valve which regulates the back pressure for the purpose of controlling the speed of the multipurpose pig elements through the transmission line since their speed is a function of the difference in the pressure applied to the rear end of the nested multipurpose pig elements and the pressure at the front end of the nested multipurpose pig elements. The technique for moving pigs or barriers though a pipeline in nested or un-nested relationship is well known to those skilled in the art. As shown in FIG. 6 transmission line 50 is normally used for the transfer of gas which, depending upon the application, may be shut off during the period of time that the various cleaning agents are transferred through the transmission line. The cleaning agents are contained in truck 56 and enter transmission line 50 through valves 58, 60, pump 62 and check valve 64.

As illustrated in FIG. 6, the nested multipurpose pig elements provide chambers 66 and 68 which in a cleaning application may contain the same or different cleaning agents. Also, the area of the pipeline immediately preceding the first of the nested multipurpose pig elements may include water. The gas flow may be re-introduced to the gas line after the last of the nested multipurpose pig elements has passed valve 70.

In another application of the multipurpose pig elements, chambers 66 and 68 may be used to carry different products through the transmission line which, for some reason or other, are desired to be maintained separated from one another during their transmission through the pipeline.

FIG. 7*a* shows the capability of the multipurpose pig to negotiate small radius bends in a pipeline. FIG. 7*b* shows the multipurpose pig exiting from a larger diameter pipe into a smaller diameter pipe. As indicated above, the multipurpose pig is capable of traversing through out-of-round pipe, mitered joints, valves and other restrictions normally found in pipelines.

What is claimed is:

1. A plug for treating the interior of pipes, comprising:

an elastomeric main body portion having a leading end and a trailing end and having a length approximately one and one-half times its diameter;

said trailing end of said body portion having a cup-shaped flange extending outwardly therefrom and defining a cavity facing away from said body portion;

said leading end of said main body portion including a hub with a central opening therethrough adapted for receiving a bolt member facilitating the securement of scraper elements to said main body portion;

said main body portion further including a hollow portion extending from said hub to said cup-shaped flange along the length of said body portion;

a plurality of reinforcing rib members extending along the longitudinal axis of said main body portion on the interior of said hollow portion; and a plurality of sealing elements extending radially outwardly from said hollow portion and spaced axially along said main body portion from said hub to said cup-shaped flange, the diameter of each of said sealing elements being substantially equivalent to the diameter of said flange.

2. The plug as defined in claim 1 further comprising a plurality of scraper elements;

a bolt extending through said central opening and through said scraper elements to mount said scraper elements to said hub; and means for fastening said bolt to said hub whereby said scraping elements are secured thereto.

3. The plug defined in claim 2 wherein each of said scraper elements includes a plurality of nipples formed thereon and holes formed therein in circumferentially spaced relation about said central opening, with the nipples and holes respectively separated by a predetermined angle, said nipples of each scraper element each engaging a hole of the next adjacent scraper element whereby each scraper element is held in a position in relation to the adjacent scraper elements in which it is rotated by said predetermined angle relative to the next adjacent scraper elements when said plurality of scraper elements are secured to said hub by said bolt.

4. A multi-purpose pipeline pig for treating the interior of pipelines, comprising:

an elastomeric elongated main body portion having a first end and a second end, said main body portion further including:

a cup-shaped portion on said first end of said main body portion inclding a flange projecting radially outwardly from said main body portion in respect to the longitudinal axis thereof, and defining a concavity facing away from said body portion;

a hub at said second end of said body portion having a central opening therethrough;

a hollow portion in said main body portion and extending from said hub at said second end thereof to said cup-shaped flange at the first end thereof along the length of said body portion; and a plurality of reinforcing rib members extending parallel to the longitudinal axis of said main body portion on the interior of said hollow portion;

a plurality of resilient sealing elements extending radially outwardly from said hollow portion and spaced axially along said main body portion between said hub and said cup-shaped flange, the diameter of each of said sealing elements being substantially equivalent to the diameter of said flange;

a plurality of scraper elements at said second end of said body portion adjacent said hub;

means extending through said opening in said hub and securing said scraper elements to said hub, each of said scraper elements including a plurality of nipples formed thereon and holes formed therein in circumferentially spaced relation about said hub central opening, with the nipples and holes respectively separated by a predetermined angle, said nipples of each scraper element each engaging the hole of the next adjacent scraper element, whereby each scraper element is held in a position in relation to the adjacent scraper elements in which it is rotated by said predetermined angle relative to the next adjacent scraper elements when said plurality of scraper elements are secured to said hub by said securing means.

5. A multi-purpose pipeline pig for treating the interior of pipes, comprising:

a resilient body having a first end and a second end and including a hollow portion extending between said first and second ends;

a cup-shaped flange extending outwardly from and around said body at the first end thereof and defining a concavity communicating with the hollow interior of said hollow portion;

an elastomeric hub at the second end of said body defining a central opening through said hub for receiving bolt means facilitating the securement of scraper elements to said body at said hub;

a plurality of resilient sealing elements extending radially outward from said hollow portion and spaced axially along said body from said hub to said cup-shaped flange, the diameter of each of said sealing elements being substantially equivalent to the diameter of said flange, and each of said sealing elements including a radiused edge at the radially outer extremity of each of the respective sealing elements and on the side thereof opposite the side facing toward the said cup-shaped flange, whereby said sealing elements may be more easily deflected by contact with a pipeline wall as said multi-purpose pipeline pig is moved through said pipeline in a direction corresponding to the direction which said hub lies from said cup-shaped flange;

a plurality of scraper elements bearing against said hub at said second end of said body, and extending radially outwardly from said body, each of said scraper elements including:

a reverse turned radially outer end portion bent through a curve in which the respective scraper element is reversed so as to extend away from the end of said body portion carrying said cup-shaped flange;

a plurality of nipples projecting from the major plane of the respective scraper element; and a plurality of holes formed therein in circumferentially spaced relation from said nipples about said central opening;

said nipples and holes of adjacent scraper elements being interlocked with each other to from an array of scraper elements extending completely about said hub in a circumferential sense; and means extending through said central opening in said hub and engaging said scraper elements to retain said scraper elements in juxtaposition to said hub.

* * * * *